US007938591B2

(12) United States Patent
Kokai

(10) Patent No.: US 7,938,591 B2
(45) Date of Patent: May 10, 2011

(54) STICK-SHAPED MATERIAL EXTRUDING CONTAINER AND COSMETICS

(75) Inventor: Kenji Kokai, Gifu (JP)

(73) Assignee: Tokiwa Corporation, Gifu (JP)

( * ) Notice: Subject to any disclaimer, the term of this patent is extended or adjusted under 35 U.S.C. 154(b) by 84 days.

(21) Appl. No.: 12/429,845

(22) Filed: Apr. 24, 2009

(65) Prior Publication Data

US 2010/0272494 A1 Oct. 28, 2010

(51) Int. Cl.
*B43K 21/08* (2006.01)

(52) U.S. Cl. ..... 401/75; 401/68; 401/176

(58) Field of Classification Search ..... 401/55, 401/68–79, 88, 171, 172, 176, 177, 173, 401/95, 98, 142; 277/431; 384/132
See application file for complete search history.

(56) References Cited

U.S. PATENT DOCUMENTS 3,334,616 A * 8/1967 Urquhart ..... 401/142
3,424,537 A * 1/1969 Henriksen ..... 401/142
3,459,486 A * 8/1969 Matschkal ..... 401/259
4,556,156 A * 12/1985 Frutin ..... 222/386.5
5,065,900 A * 11/1991 Scheindel ..... 222/1
2003/0108376 A1* 6/2003 Hurlburt ..... 401/88
2006/0177257 A1* 8/2006 Tsaur ..... 401/132
2009/0123213 A1* 5/2009 Tani ..... 401/75

FOREIGN PATENT DOCUMENTS

JP 2008043591 A * 2/2008

* cited by examiner

*Primary Examiner* — Gregory L Huson
*Assistant Examiner* — Keegan Gumbs
(74) *Attorney, Agent, or Firm* — Hanley, Flight & Zimmerman, LLC

(57) ABSTRACT

A stick-shaped material extruding container and cosmetics using the container are provided. The stick-shaped material extruding container is provided with a piston-shaped extruding portion which is located at the front end of a moving body and tightly slides in a filling part; the stick-shaped material is tightly filled within the filling part; there exists sealant between the stick-shaped material and the extruding portion, which sealant contains one or more components chosen from the group consisting of oil components which assume liquid state at room temperature and polyols which assume liquid state at room temperature; the extruding portion and the stick-shaped material maintain in a tight engagement state in the filling part by means of the sealant with the mobile body being retracted.

4 Claims, 4 Drawing Sheets

STICK-SHAPED MATERIAL EXTRUDING CONTAINER AND COSMETICS

TECHNICAL FIELD

The present invention relates to stick-shaped material extruding container that is adapted to screw out the stick-shaped material for use, and to cosmetics.

BACKGROUND

A container that is conventionally known to be used as a container for stick-shaped cosmetic materials comprises a cylindrical sleeve with two ends open, a cylindrical operation portion which is rotatably connected to the sleeve and can not move in the axial direction, a cylindrical inner case fitted within the rear half of the cylindrical sleeve, which may move in the axial direction, but is incapable of rotation, and a stick-shaped cosmetic material that is filled directly from the aft end side of the sleeve, which is fitted with the inner case and is equipped with a cap at the front end thereof. When relative rotation takes place between the sleeve and the operation portion, the inner case moves forward or retracts with respect to the sleeve, such that the stick-shaped cosmetic material draws in and out from the front end of the sleeve. (see, for example, patent document 1)

Patent document 1: Japanese publication No. 2001-87033

However, with a thus configured container for a stick-shaped cosmetic material, an issue rises that the stick-shaped cosmetic material tends to disengaged from the inner case and thus come off the container, for example, particularly when the container is subjected to impacts or vibrations when falling down, etc.

To solve this problem, the applicant proposed a stick-shaped material extruding container, wherein the stick-shaped material was retracted by means of the sucking action produced from retreating an extruding portion of a piston shape (Japanese publication No. 2008-43591). Nevertheless, the applicant has found by researching that the stick-shaped material can not be retracted completely such as in the case of using the container at low temperatures in winter.

SUMMARY OF THE INVENTION

Therefore, the object of the invention is to provide a stick-shaped material extruding container and cosmetics using the same, wherein the container can extrude and retract the stick-shaped material, particularly the stick-shaped cosmetic material without any problems, can prevent the stick-shaped material from coming off the container at the presence of the external forces due to impacts or vibrations or the like, and the stick-shaped material will not occur retractation malfunction even at low temperatures.

The stick-shaped material extruding container according to the invention comprises a cylindrical filling part which is fitted in the container and has both ends open, and a stick-shaped material filled within the filling part. When the front portion of the container and the aft portion of the container which is rotatable relative to the front portion rotate with respect to each other along one direction, a mobile body equipped within the container moves forward in such a way that the stick-shaped material emerges from the open portion at the front end of the container; when the front portion of the container and the aft portion of the container rotate with respect to each other along another direction that is opposite to the one direction, the mobile body retracts; the stick-shaped material extruding container is characterized in that an extruding portion in a piston shape is provided in the container, which is located at the front end of the mobile body and tightly slides in the filling part; the stick-shaped material is tightly filled within the filling part; there exists sealant between the stick-shaped material and the extruding portion, which sealant has a viscosity of 1,300,000 mPa·s or lower at the temperature of 5° C., and which contains one or more components chosen from the group consisting of oil components which assume liquid state at room temperature and polyols which assume liquid state at room temperature; the extruding portion and the stick-shaped material maintain in a tight engagement state in the filling part by means of the sealant with the mobile body being retracted, and under this state, a sucking action produced from retracting the extruding portion acts to withdraw the stick-shaped material within the filling part.

In such a stick-shaped material extruding container, the extruding portion is located at the front end of the mobile body that is equipped within the container and is intended for advancing/retracting. The extruding portion is tightly engaged in the filling part, so does the stick-shaped material that is filled within the filling part, in such a way that the extruding portion and the stick-shaped material configured in a form of piston assume a tight engagement state in the filling part, thus, as the extruding portion advancing, the stick-shaped material is screwed out to emerge from the open portion at the front end of the container; as the extruding portion retracting, a sucking action (the action serves as maintaining tight engagement) that is produced due to negative pressure between the extruding portion and the stick-shaped material acts to withdraw the stick-shaped material within the filling part. In this manner, the stick-shaped material may be moved forward and withdrawn without any problems. Furthermore, the tendency of the extruding portion and the stick-shaped material being disengaged due to external forces imposed thereon resulting from impacts or vibrations is avoided due to the effect of tight engagement arising from the fact that the extruding portion and the stick-shaped material assume a negative pressure state, in this way the stick-shaped material may be prevented from falling off the container. Furthermore, as described above, since the stick-shaped material (such as particularly soft materials that can not be modeled in a conventional stick shape, for example, materials in form of gel or Mousse) is tightly engaged within the filling part, even if the stick-shaped material is broken off in the filling part, the broken portion will not disengage from the filling part and may still be used. In addition, with the described above constructed sealant presenting between the extruding portion and the stick-shaped material, the retractation malfunction of the stick-shaped material can be inhibited even at low temperatures. Furthermore, as the reasons for such an effect to the invention, the inventor conjectures as follows. Firstly, the inventor thinks the reason for the retractation malfunction is attributed to the stick-shaped material contracting at low temperatures (in particular lower than 5° C.), clearance occurring between the stick-shaped material and the extruding part, leading to penetration of air into the clearance and thus a lowered sucking action. According to the conjectured by the inventor, the clearance is prevented from occurring so as to improve the retractability at low temperatures due to the sealant in this invention.

Furthermore, in the stick-shaped extruding container according to the invention, it is preferable that the viscosity of the sealant is 4000 mPa·s~1,000,000 mPa·s at the temperature of 5° C. If the viscosity of the sealant is within the above region, it is easy to uniformly fill the sealant into the predetermined position in the filling part, the retractation malfunction can be further reliably inhibited at low temperatures, and the sealant can be further reliably prevented from leaking from between the stick-shaped material and the filling part.

In addition, in the container as described in the Patent Document 1, the aft end face of the stick-shaped cosmetic material is open backwards across a cylindrical inner case. In the case of presence of external forces due to impacts or vibrations, no tight engagement due to negative pressure between the stick-shaped cosmetic and the inner case will present, therefore the stick-shaped cosmetic material tends to come off the inner case.

In a preferable structure herein, the mobile body moves forward in the case of the front portion and the aft portion of the container rotate relative to each other in one direction, and the mobile body that is located in some place after advancing retracts by a determined amount and then stops in the case of the front portion and the aft portion of the container rotate relative to each other in another direction. In the case of employing such structure, if the front portion and the aft portion of the container rotate relative to each other in another direction, the mobile body that is located in some place after advancing only retracts by a determined amount and then stops, or in other terms, the retractation will not be exceed a determined amount. Therefore, the mobile body can be prevented from retracting excessively, and the case that the stick-shaped material can not emerge from the open portion during next usage will never occur, thus improving the useability (wieldy useability).

In a further preferable structure, the container comprises a first threaded engagement portion and a second threaded engagement portion therein. When the front portion of the container and the aft portion of the container rotate relative to each other in another direction, the first and second threaded engagement portions in combination serve to move forward the mobile body. When the threaded engagement effect of the first threaded engagement portion serves to a predetermined amount, the threaded engagement of the first threaded engagement portion is released. In the case of further rotation relative to each other in said one direction, only the threaded engagement effect of the second threaded engagement portion serves to move forward the mobile body. In the case of this structure, with the double threaded structure resulting from the first and second threaded engagement portions, the length of the stick-shaped material can be ensured while the length of the stick-shaped material extruding container in the axial direction is saved. Furthermore, the mobile body moves forward rapidly by the combined effect of the first and second threaded engagement portions, and moves forward slowly by the thread engagement effect only from the second threaded engagement portion after advancing over a predetermined amount. In this manner, the situation in which the stick-shaped material is screwed out excessively by a mistake may be avoided.

An alternative structure is also possible, wherein the container comprises a first threaded engagement portion and a second threaded engagement portion therein. When the front portion of the container and the aft portion of the container rotate relative to each other in another direction, the first and second threaded engagement portions in combination serve to retract the mobile body. When the threaded engagement effect of the first threaded engagement portion serves to a predetermined amount, the threaded engagement of the first threaded engagement portion is released. In the case of further rotation relative to each other in said another direction, only the threaded engagement effect of the second threaded engagement portion serves to retract the mobile body. In the case of this structure, with the double screw structure resulting from the first and second threaded engagement portions, the length of the stick-shaped material can be ensured while the length of the stick-shaped material extruding container in the axial direction is saved. Furthermore, the mobile body retracts rapidly by the combined effect of the first and second threaded engagement portions, and retracts slowly by the thread engagement effect from only the second threaded engagement portion after retracting over a predetermined amount.

In a further preferable structure, the stick-shaped material is filled within the filling part, and the filling part filled with the stick-shaped material is fitted into the container. In the case of employing such structure, since the stick-shaped material is filled within only the cylindrical filling part with both ends open, the thickness of the filling part is uniform, the radial thickness of the stick-shaped material is constant along the axial direction, and the temperature condition is made stable from filling the molten stick-shaped material till solidifying. Thus the stick-shaped material is well filled, leading to a higher yield. Furthermore, since the structure wherein the filling part filled with stick-shaped material is fitted into the container, the manufacture becomes easier. In this case, the sealant may be filled above the stick-shaped material filled within the filling part.

It is also preferable to fill the stick-shaped material structure within the filling part equipped in the container. In the case of employing such arrangement, similarly as described above, filling property of the stick-shaped material is excellent and leading to a higher yield due to the fact that the stick-shaped material is only filled within the cylindrical filling part with both ends open. Furthermore, due to the structure wherein the stick-shaped material is filled within the filling part equipped in the container, the manufacture becomes easier. In this situation, a sealant is filled into the filling part in such a way that the sealant is located on the extruding portion before the stick-shaped material is filled.

It is further preferable to employ transparent materials for the filling part. In this case, the status of the stick-shaped material filled within the filling part may be identified from outside.

The invention further provides cosmetics comprising the stick-shaped material extruding container according to the invention and cosmetic materials filled in a form of the stick-shaped material.

According to the invention, the stick-shaped material may be moved forward and withdrawn without any problems, at the same time the stick-shaped material is prevented from coming off the container at the presence of the external forces due to impacts or vibrations or the like, and the stick-shaped material may still be used even if it is breaked off. In addition, very soft stick-shaped material may be used, which is not suitable for maintaining a stick shape in a conventional manner. Furthermore, retraction malfunction of the stick-shaped material is avoided at low temperatures.

REFERENCE NUMERALS

Figure 1:
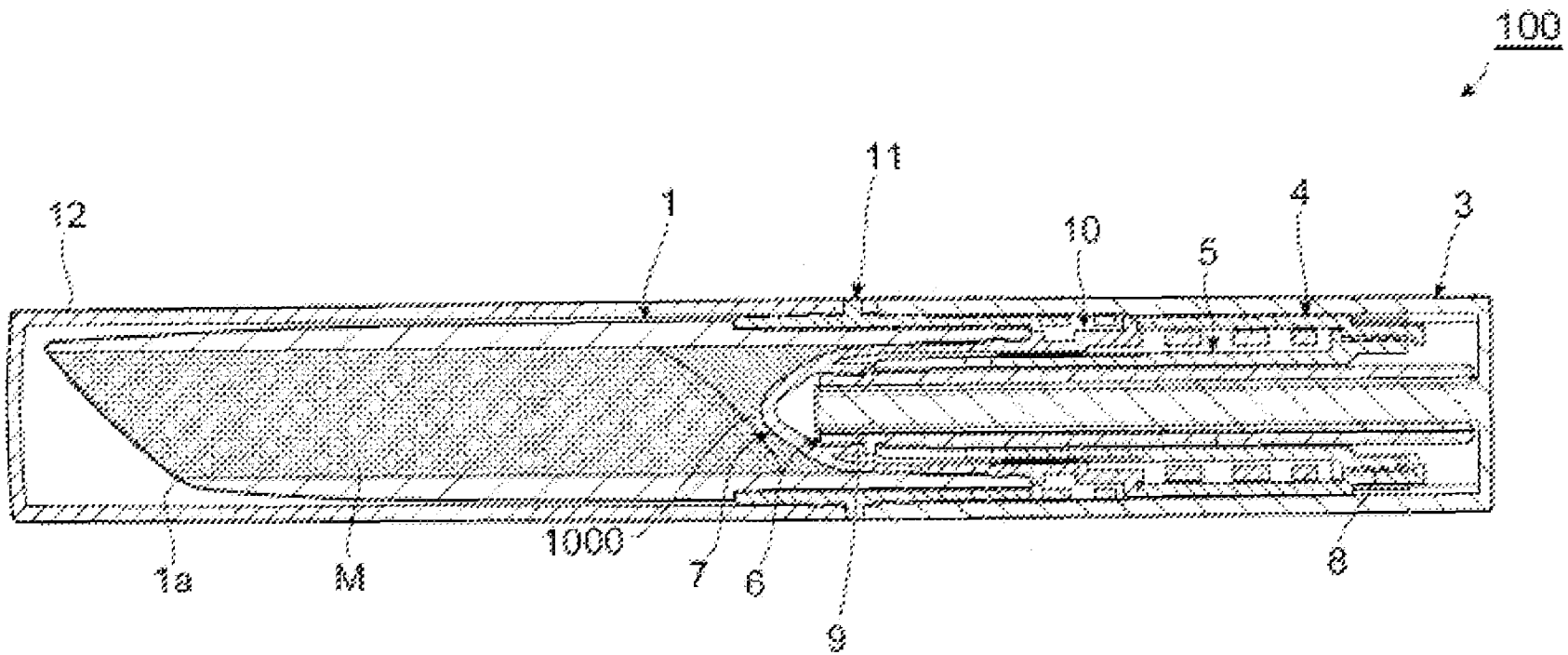
FIG. 1 is a longitudinal cross-section view showing the initial state of a stick-shaped material extruding container according to a first embodiment of the invention.
Figure 2:
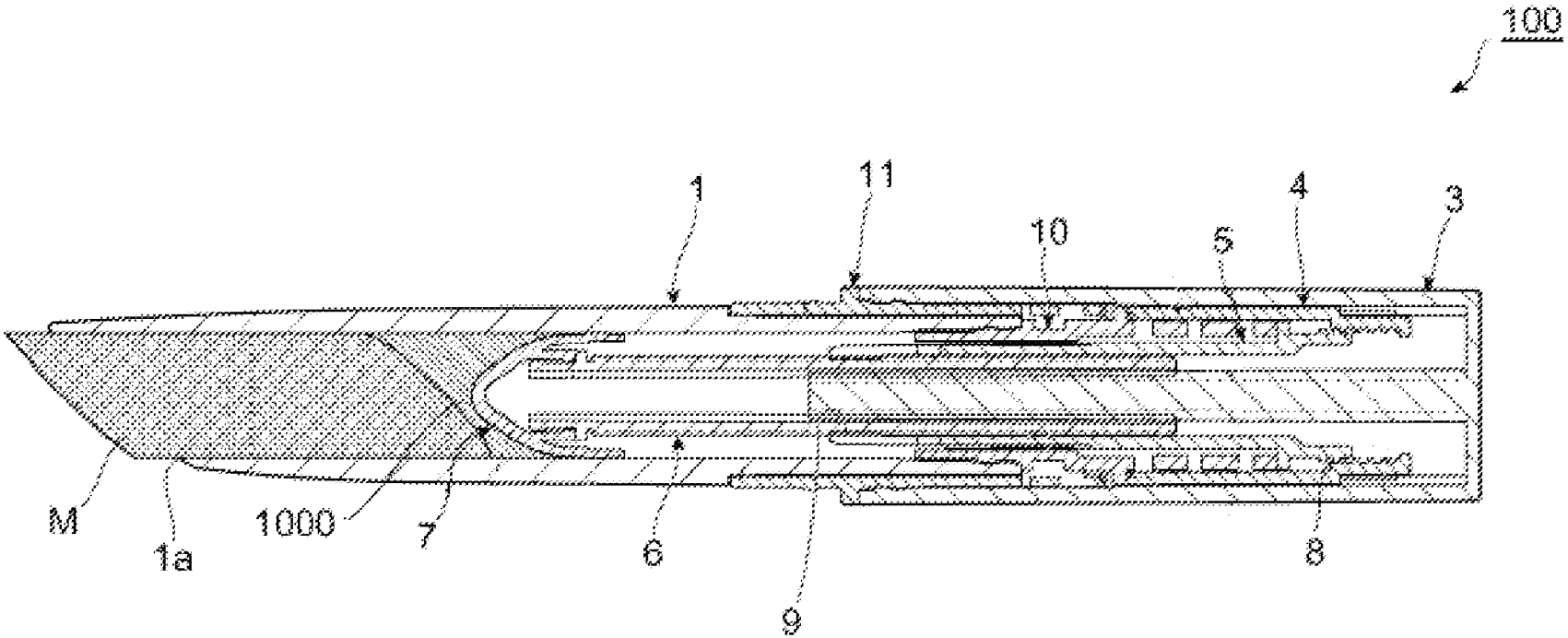
FIG. 2 is a longitudinal cross-section view showing the state in which the cap is removed from the state shown in FIG. 1, and the mobile screw cylinder and the mobile body are moved forward due to user's action.
Figure 3:
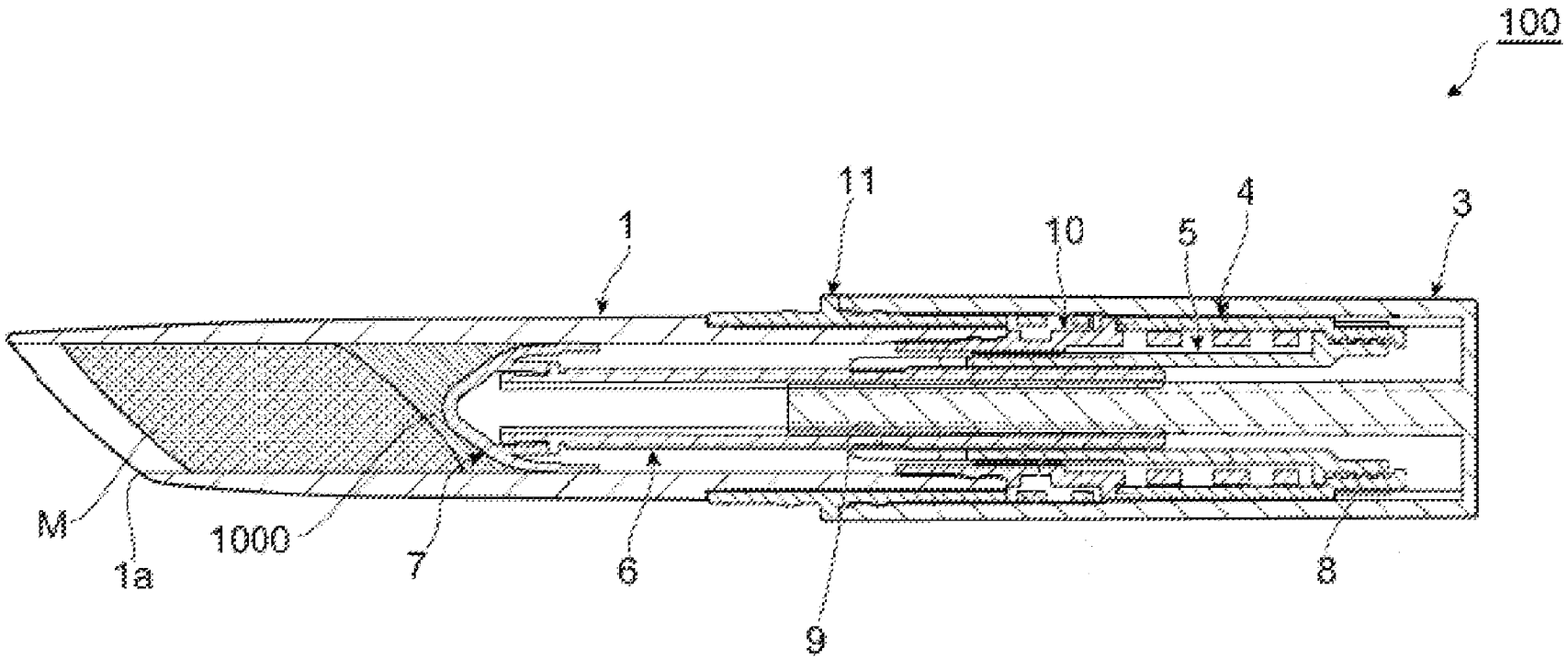
FIG. 3 is a longitudinal cross-section view showing the state in which the user, after using the stick-shaped material, acts to retreat the mobile screw cylinder and the mobile body from the state shown in FIG. 2, and the mobile screw cylinder is retracted to the backward limit.
Figure 4:
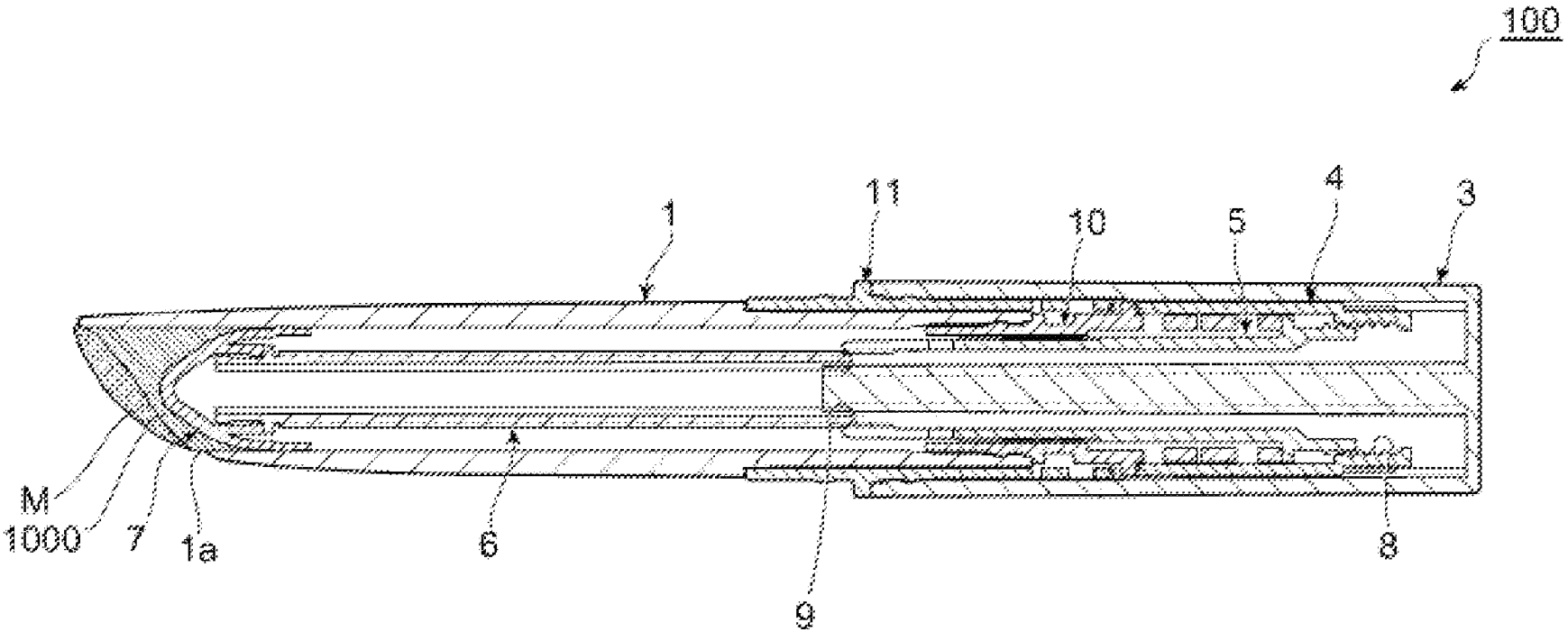
FIG. 4 is a longitudinal cross-section view showing the mobile body moving forward to the limit from the state shown in FIG. 2, due to user's action.

1 a filling part (the front portion of the container)
1*a* an open portion of the front end of the container
3 a body cylinder (the aft portion of the container)
6 a mobile body
7 a piston (an extruding part)
8 a first threaded engagement part
9 a second threaded engagement part
100 a stick-shaped material extruding container (container)
1000 sealant
M a stick-shaped material

EMBODIMENTS OF THE INVENTION

Thereafter, the preferred embodiments of the stick-shaped material extruding container of the invention will be described with reference to FIG. 1 to 4. Identical reference numerals will be employed to designate the same element throughout, and the repeated description will be omitted.

FIG. 1 to 4 are longitudinal cross-section views showing the individual states of the stick-shaped material extruding container according to the embodiment of the invention, respectively. The stick-shaped material extruding container of the embodiment may be used to contain a stick-shaped material in such a way that the material may be properly screwed out though user's action.

Herein, as a stick-shaped material, there may be used various stick-shaped cosmetic materials, such as a lipstick, a lipprotector, an eyeliner, an eye shadow, an eyebrowpencil, a lippencil, a rouge, a concealer, a makeup stick, and hair dye cream, to name just a few, and stick-shaped cores for recording tools, in particular, when a very soft stick-shaped material (in a semi-solid state, a soft solid state, in a soft state, in a form of gel or Mousse) is employed, since then a tight engagement with the piston 7 or the filling part 1 as described thereafter will present, such the structure is preferable. Furthermore, a thin stick-shaped material with an outer diameter of 1 mm or less or a thick stick-shaped material with an outer diameter of 10 mm or above may also be employed.

As shown in FIG. 1, the stick-shaped material extruding container 100, which acts as a profile structure, comprise a cylindrical filling part 1 and a body cylinder (body) 3, the both ends of the cylindrical filling part 1 being open, and the aft portion of the filling part 1 being inserted into the front portion of the body cylinder 3. The body cylinder 3 is connected to the filling part 1 so as to allow relative rotation therebetween, however, they can not disengage from each other in the axial direction. The filling part 1 constitutes the front portion of the container, and the body cylinder 3 constitutes the aft portion thereof.

Furthermore, the stick-shaped material extruding container 100 comprises substantially therein a stick-shaped material M which is filled in the filling part 1; a screw cylinder 4 which is connected to the body cylinder 3 in a manner of allowing synchronous rotation and incapable of disengaging in the axial direction; a rotary part 10 which is connected to the filling part 1 in a manner of allowing synchronous rotation and incapable of disengaging in the axial direction; a middle part 11 which is connected to the body cylinder 3 in a manner of allowing synchronous rotation and incapable of disengaging in the axial direction and elastically urges the rotary part 10 in the axial direction such that the rotary part 10 can not be disengaged in the axial direction; a mobile screw cylinder 5 which is snapped to the rotary part 10 in a manner of allowing synchronous rotation and moving in the axial direction, which is threadedly engaged with the screw cylinder 4 via a first thread engagement part 8, which moves forward when the filling part 1 constituting the front portion of the container and the body cylinder 3 constituting the aft portion of the container are rotated relative to each in one direction, i.e., the extruding direction, and stops advancing when reaching a forward limit, and which retreats when the filling part 1 and the body cylinder 3 are rotated relative to each in an opposite direction, i.e., the retracting direction, and stops retreating when reaching a backward limit; a mobile body 6 which is snapped to the body cylinder 3 in a manner of allowing synchronous rotation and moving in the axial direction, which is threadedly engaged with the mobile screw cylinder 5 via a second thread engagement part 9, which, when the filling part 1 and the body cylinder 3 are rotated relative to each in one direction, moves forward following the mobile screw cylinder 5 while at same time advancing individually, and moves forward only individually when the mobile screw cylinder 5 reaches a forward limit and the filling part 1 and the body cylinder 3 are further rotated relative to each in the same direction, and which, when the filling part 1 and the body cylinder 3 are rotated relative to each in an opposite direction, retreats following the mobile screw cylinder 5 while at the same time retreating individually, and stops retreating together with the mobile screw cylinder 5 when the mobile screw cylinder 5 reaches a backward limit; and a piston (a piston like extruding part) 7 which is fitted at the front end of the mobile body 6, inserted into the filling part 1 so as to slide. In addition, the stick-shaped material extruding container 100 has a sealant 1000 interposed between the stick-shaped material M and the piston (a piston like extruding part) 7.

The sealant 1000 is constituted of the sealant according to the invention. The sealant contains one or two or more components selected from the group consisting of oils which assume liquid state at room temperature and polyols which assume liquid state at room temperature, and its viscosity is 1,300,000 mPa·s or lower at the temperature of 5° C.

As oil component which is in the form of liquid at room temperature, the material commonly used in the cosmetic material can be employed, for example, hydrocarbons, fats and oils, solidifying oils, ester oils, fat acids, higher alcohols, silicone oils, fluorine-containing oils, lanolin derivatives and the like, irrespective of the origin such as vegetable oil, synthetic oil etc. Specific examples of the oil component which is in the form of liquid at room temperature may include hydrocarbons such as liquid paraffin, squalane, polyisobutylene, polybutene; fats and oils such as olive oil, castor oil, Jojoba oil, Macadamia nut oil; ester oils such as cetyl isooctanoate, isopropyl myristate, isopropyl hexadecanoate, octyl lauryl myristate, glyceryl trioctanoate, polyglyceryl diisostearate, diglyceryl triisostearate, glyceryl tri(docosanoate), neopentyl glycol dioctanoate, cholesterol fatty acid ester, di(cholesteryl-octyl lauryl) N-lauroyl-L-glutamate; higher alcohols such as isostearic acid, oleic acid, lauryl alcohol, oleyl alcohol, isostearyl alcohol, octyl dodecanol; silicone oils such as dimethyl polysiloxane with low degree of polymerization, dimethyl polysiloxane with high degree of polymerization, methylphenyl polysiloxane, polyether-modified polysiloxane, poly oxyalkylene-alkylmethyl polysiloxane-methyl polysiloxane copolymer, alkoxy-modified polysiloxane, fluorine-modified polysiloxane; fluorine-containing oils such as perfluorodecane, perfluorooctane, perfluoropolyether; lanolin derivatives such as liquid lanolin, lanolin alcohol. These liquid oil components may be used alone or two or more kinds in combination.

Various polyols may be used as liquid polyol, such as ethylene glycol, diglycol, propylene glycol, dipropylene glycol, 1,3-butanediol, 1,4-butanediol, glycerol monoacetate, glycerin, triglycerin, hexaglycerol, decaglycerol. These polyols may be employed alone or two or more of them may be employed combination.

The sealant 1000 may contain one of the above mentioned liquid oils and liquid polyols, or contain two or more of them in combination.

Desirably, the viscosity of the sealant 1000 is 1,300,000 mPa·s or less at the temperature of 5° C. so as to sufficiently inhibit retractation malfunction at low temperatures. Further, the sealant 1000 preferably has a viscosity of 4000 mPa·s~1,000,000 mPa·s at 5° C. If the viscosity of the sealant is within the above region, the sealant can be easily filled into the predetermined position within the filling part, and the effect that prevents the retractation malfunction at low temperatures can be further reliably achieved, and the sealant can be further reliably prevented from leaking from between the stick-shaped material and the filling part.

As described above, the stick-shaped material used within the stick-shaped material extruding container according to the present invention may be, for example, various stick-shaped cosmetic materials, such as a lipstick, a lipprotector, an eyeliner, an eye shadow, an eyebrowpencil, a lippencil, a rouge, a concealer, a makeup stick, and hair dye cream to name just a few, and stick-shaped cores for recording tools, etc. According to the present invention, it is particularly advantageous to provide cosmetics equipped with the above described stick-shaped material extruding container and the above described cosmetic materials filled therein in a stick shape.

EXAMPLES

The invention will be described in further details thereafter by way of examples. However, the invention is not limited thereto by any means.

[Preparation of Composition for Stick-Shaped Materials Formation]

The composition for lipstick formation as described thereafter is prepared as the composition to be filled with the stick-shaped material extruding container so as to form stick-shaped material.

<Composition for Lipstick Formation>

| (component) | (mass %) |
|---|---|
| 1. Polyethylene | 4.00 |
| 2. Vaseline | 25.00 |
| 3. Hydrogenated Polyisobutylene | 30.00 |
| 4. Polybutylene | 3.00 |
| 5. Squalane | 2.00 |
| 6. *Macadamia* Nut Oil | 15.00 |
| 7. Tocopherol | 0.02 |
| 8. Diisostearyl Malate | 14.24 |
| 9. Simethicone | 0.02 |
| 10. Red 202 | 0.12 |
| 11. Titanium Dioxide | 0.59 |
| 12. Ferric Oxide (Ferric Oxide Red) | 0.50 |
| 13. Yellow 4 | 0.60 |

-continued

| (component) | (mass %) |
|---|---|
| 14. Borosilicic Acid (Ca/Na) | 2.91 |
| 15. Silylated Silica | 2.00 |

<Preparation Method>

The components 1 to 9 are heated, dissolved, mixed and dissipated, and then the component 10 to 13 and 15 are added thereto and roll dissipated. Finally component 14 is mixed therein so as to obtain the composition for lipstick formation.

[Preparation of Cosmetics]

Examples 1~21 and Comparative Examples 1~7

A stick-shaped material extruding container with the same structure as that of shown in FIG. 1 is prepared (an inner diameter of the filling part: 7.6 mm). The container is filled with 0.1 ml sealant consisting of the components shown in Tables 1 and 2 respectively. Then, at a temperature of 75~90° C., the composition for lipstick formation obtained in the above described manner is infused into respective containers filled with sealant, and the composition is cooled to solidify so as to obtain cosmetics (lipstick). In addition, after the sealant is kept at the temperature of 5° C. for 30 seconds, the viscosity at 5° C. of the sealant is measured via a VAR-50 viscositymeter (manufactured by Reologica) at the conditions that the shear speed is 4.0 (l/s), the diameter of the plates is 25 mm, and the clearance is 1 mm.

The method as described therebelow is employed to evaluate the filling property of the sealant during manufacture, the retractability of the stick-shaped material at low temperatures (5° C.) and the leakage property of the sealant associated with the resultant cosmetics. The results are shown in Tables 1 and 2.

(Filling Property of the Sealant)

The dissipation of sealant when being filled into the filling part is observed and identified visually. The filling property is evaluated according to the following criteria.

◎: The sealant dissipates uniformly in relative short period.

○: It takes a little time for the sealant to dissipate.

Δ: The dissipation of the sealant is somehow unsatisfying.

X: The sealant dissipates insufficiently.

(Retractability)

The cosmetic is taken out after being kept in an attemperator of 5° C. for 2 hours or longer, and is immediately screwed out by 10 mm and then retracted for five times successively. After that, the length of the stick-shaped material that is not retracted to the original position is measured, and the retractability is evaluated according to the following criteria.

◎: The length that is not retracted is less than 0.5 mm.

○: The length that is not retracted is above 0.5 mm and less than 2.0 mm.

Δ: The length that is not retracted is above 2.0 mm and less than 4.0 mm.

X: The length that is not retracted is above 4.0 mm.

(Leakage Property)

After screwing out by 10 mm and then retracting are carried out for five times successively, the sealant that leaks from between the filling part and the stick-shaped material is observed and identified visually, and the leakage property is evaluated according to the following criteria.

◎: No leakage is seen.

○: Slight leakage is found.

Δ: Leakage to the extent that usage feeling changes is found.

X: Significant leakage is found.

In addition, the components in Tables 1 and 2 make use of the following materials.

Thick glycerin: "cosmetic thick glycerin" (product of Kao Co., Ltd., trade name, in a liquid state at room temperature (25° C.))

Macadamia nut oil: "CROPURE MACADAMIA" (product of Croda Japan Co., Ltd., trade name, in a liquid state at room temperature (25° C.))

Isostearic acid: "isostearic acid" (product of Nissan Chemical Industries Co. Ltd., trade name, in a liquid state at room temperature (25° C.))

Glyceryl tri2-ethyl hexanoate: "MYRITOL GTEH" (product of Cognis Japan Co., Ltd., trade name, in a liquid state at room temperature (25° C.))

Glyceryl triisostearate: "TISG" (product of Kokyu alcohol kogyo Co. Ltd., trade name, in a liquid state at room temperature (25° C.))

Poly glyceryl triisostearate: "DG oil IS-213P" (product of National Bimatsu Co., Ltd., trade name, in a liquid state at room temperature (25° C.))

Diisostearyl Malate: "COSMOL 222" (product of Nisshin Oillio Group, trade name, in a liquid state at room temperature (25° C.))

Heavy fluid isoparaffin A: "PARLEAM 18" (product of NOF Co., Ltd., trade name, in a liquid state at room temperature (25° C.))

Heavy fluid isoparaffin B: "PARLEAM 24" (product of NOF Co., Ltd., trade name, in a liquid state at room temperature (25° C.))

Heavy fluid isoparaffin C: "PARLEAM 46" (product of NOF Co., Ltd., trade name, in a liquid state at room temperature (25° C.))

Methyl polysiloxane A: "KF-96A-10cs" (product of Shin-Etsu Chemical Co., Ltd., trade name, in a liquid state at room temperature (25° C.))

Methyl polysiloxane B: "KF-96-1000cs" (product of Shin-Etsu Chemical Co., Ltd., trade name, in a liquid state at room temperature (25° C.))

Methyl polysiloxane C: "KF-96-3000cs" (product of Shin-Etsu Chemical Co., Ltd., trade name, in a liquid state at room temperature (25° C.))

High polymerization methyl polysiloxane A: "KF-96A-5000cs" (product of Shin-Etsu Chemical Co., Ltd., trade name, in a liquid state at room temperature (25° C.))

High polymerization methyl polysiloxane B: "KF-96H-10000cs" (product of Shin-Etsu Chemical Co., Ltd. trade name, in a liquid state at room temperature (25° C.))

High polymerization methyl polysiloxane C: "KF-96H-50000cs" (product of Shin-Etsu Chemical Co., Ltd., trade name, in a liquid state at room temperature (25° C.))

Dextrin Palmitate: "RHEOPEARL KL2" (Chiba Flour Milling Co., Ltd., trade name)

Silanized silicic anhydride: "AEROSIL R974" (NIPPON AEROSIL Co., Ltd., trade name)

Carboxy vinyl polymer aqueous solution: 1.2 mass % aqueous solution of "AQUPEC HV-505E" (product of Sumitomo Seika Chemicals Co., Ltd., trade name)

Vaseline: "sunwhite P-150" (product of Nikko Rica Co., Ltd., trade name, in a semi-solid state at room temperature (25° C.))

Dipentaerythritol fatty acid ester: "COSMOL 168ARV" (product of Nisshin Oillio Group, trade name, in a semi-solid state at room temperature (25° C.))

TABLE 1

| | Components of Sealant | Properties of sealant at room temperature (25° C.) | Viscosity of sealant at 5° C. (mPa · s) | Filling property | Retractability (5□) | Leakage property |
|---|---|---|---|---|---|---|
| Example 1 | thick glycerin | liquid | 5791 | □ | □ | □ |
| Example 2 | macadamia nut oil | liquid | 176 | □ | □ | ○ |
| Example 3 | isostearic acid | liquid | 10922 | □ | □ | □ |
| Example 4 | glyceryl tri2-ethyl hexanoate | liquid | 105 | □ | □ | ○ |
| Example 5 | mixture of glyceryl tri2-ethyl hexanoate and poly glyceryl triisostearate (1:1, mass ratio) | liquid | 353 | □ | □ | ○ |
| Example 6 | glyceryl triisostearate | liquid | 590 | □ | □ | ○ |
| Example 7 | poly glyceryl triisostearate | liquid | 1680 | □ | □ | ○ |
| Example 8 | mixture of poly glyceryl triisostearate and diisostearyl malate (1:1, mass ratio) | liquid | 3720 | □ | □ | ○ |
| Example 9 | diisostearyl malate | liquid | 35758 | □ | □ | □ |
| Example 10 | heavy fluid isoparaffin a | liquid | 132580 | □ | □ | □ |
| Example 11 | heavy fluid isoparaffin b | liquid | 651930 | □ | □ | □ |
| Example 12 | mixture of heavy fluid isoparaffin a and heavy fluid isoparaffin c (1:1, mass ratio) | liquid | 904570 | □ | □ | □ |
| Example 13 | methyl polysiloxane a | liquid | 12 | □ | □ | ○ |
| Example 14 | methyl polysiloxane b | liquid | 1578 | □ | □ | ○ |
| Example 15 | methyl polysiloxane c | liquid | 4639 | □ | □ | □ |
| Example 16 | high polymerization methyl polysiloxane a | liquid | 7664 | □ | □ | □ |
| Example 17 | high polymerization methyl polysiloxane b | liquid | 16166 | □ | □ | □ |
| Example 18 | high polymerization methyl polysiloxane c | liquid | 81854 | □ | □ | □ |
| Example 19 | mixture of poly glyceryl triisostearate (98 mass %) and dextrin palmitate (2 mass %) | liquid | 6374 | □ | □ | □ |
| Example 20 | mixture of diisostearyl malate (98 mass %) and silylated silicic anhydride (2 mass %) | liquid | 61138 | □ | □ | □ |
| Example 21 | mixture of heavy fluid isoparaffin b and heavy fluid isoparaffin c (1:1, mass ratio) | liquid | 1268700 | ○ | ○ | □ |

TABLE 2

| | Sealant component | Properties of sealant at room temperature (25° C.) | Viscosity of sealant at 5° C. (mPa · s) | Filling property | Retractability (5□) | Leakage Property |
|---|---|---|---|---|---|---|
| Comparative Example 1 | N.A. | — | — | — | X | — |
| Comparative Example 2 | purified water | liquid | — | □ | X | X |
| Comparative Example 3 | mixture of heavy fluid isoparaffin B and heavy fluid isoparaffin C (1:2, mass ratio) | liquid | 1744700 | □ | □ | □ |
| Comparative Example 4 | heavy fluid isoparaffin C | liquid | 2948800 | □ | X | □ |
| Comparative Example 5 | carboxy vinyl polymer aqueous solution | liquid | 1185 | □ | X | X |
| Comparative Example 6 | vaseline | semi-solid oil | 300160 | □ | X | □ |
| Comparative Example 7 | dipentaerythritol fatty acid ester | semi-solid oil | can't be detected | □ | X | □ |

As can be seen from Tables 1 and 2, the lipsticks according to examples 1 to 21 present excellent retractability at low temperatures (5° C.). In addition, with lipsticks made from one or more sealants which are chosen from the group consisting of oil components that are in liquid state at room temperature and liquid polyols that are in liquid state at room temperature, and which has a viscosity of 4000 mPa·s~1,000,000 mPa·s at the temperature of 5° C., the filling property of the sealant during manufacture, the retractability of the stick-shaped material at low temperatures (5° C.) and the leakage property of the sealant are proved to be excellent.

The invention claimed is:

1. A stick-shaped material extruding container comprising a cylindrical filling part which is fitted in the container and has first and second open ends; a stick-shaped material within the filling part; a mobile body equipped within the container to move forward when a front portion of the container and an aft portion of the container which is rotatable relative to the front portion rotate with respect to each other in a first direction, the mobile body to move such that the stick-shaped material emerges from an opening of the container; the mobile body to retract when the front portion of the container and the aft portion of the container rotate with respect to each other in a second direction that is opposite to the first direction, the mobile body to retract; the container comprising:

an extruding portion in a piston shape in the container and located at a front end of the mobile body to tightly slide in the filling part;

sealant between the stick-shaped material and the extruding portion, the sealant to engage the stick-shaped material, the sealant having a viscosity of 1,300,000 mP·s or lower at a temperature of 5° C., and containing one or more components chosen from the group consisting of oil components which assume liquid state at room temperature and polyols which assume liquid state at room temperature;

the extruding portion and the stick-shaped material held in a tight engagement state in the filling part by the sealant when the mobile body is retracted, and a sucking action produced from retracting the extruding portion acts to withdraw the stick-shaped material within the filling part when in the engagement state.

2. The stick-shaped material extruding container according to claim 1, wherein the viscosity of the sealant is 4000 mP·s~1,000,000 mP·s at the temperature of 5° C.

3. The stick-shaped material extruding container according to claim 1, wherein the stick-shaped material comprises cosmetic material.

4. The stick-shaped extruding container according to claim 2, wherein the stick-shaped material comprises cosmetic material.

* * * * *